US007632135B2

(12) United States Patent
Tsukumo

(10) Patent No.: US 7,632,135 B2
(45) Date of Patent: Dec. 15, 2009

(54) ELECTRICAL CONNECTOR

(75) Inventor: Hidehiro Tsukumo, Tokyo (JP)

(73) Assignee: Hirose Electric Co., Ltd., Tokyo (JP)

( * ) Notice: Subject to any disclaimer, the term of this patent is extended or adjusted under 35 U.S.C. 154(b) by 0 days.

(21) Appl. No.: 12/216,285

(22) Filed: Jul. 2, 2008

(65) Prior Publication Data

US 2009/0011634 A1 Jan. 8, 2009

(30) Foreign Application Priority Data

Jul. 6, 2007 (JP) ..... 2007-178893

(51) Int. Cl.
*H01R 12/24* (2006.01)

(52) U.S. Cl. ..... 439/495

(58) Field of Classification Search ..... 439/495, 439/260, 635

See application file for complete search history.

(56) References Cited

U.S. PATENT DOCUMENTS 6,666,711 B2 * 12/2003 Takashita et al. ..... 439/495

2004/0180572 A1 * 9/2004 Chiu ..... 439/495

FOREIGN PATENT DOCUMENTS

JP 08-195256 7/1996

* cited by examiner

*Primary Examiner*—Phuong K Dinh
(74) *Attorney, Agent, or Firm*—Kubotera & Associates, LLC

(57) ABSTRACT

An electrical connector for a flat conductive member includes a housing with an opening portion, a plurality of terminals each having a contact portion, and a pressing member movable between an open position and a closed position. A sucking surface is formed on the pressing member, so that a suction device sucks the sucking surface. The pressing member has a shaft portion including a guided portion and an abutting portion with a supported surface. Each of the terminals has a guide portion and a supporting portion. The guide portion guides the guided portion. The supporting portion supports the supported surface when the pressing member is situated at the open position.

10 Claims, 7 Drawing Sheets

ELECTRICAL CONNECTOR

BACKGROUND OF THE INVENTION AND RELATED ART STATEMENT

The present invention relates to an electrical connector for a flat conductive member.

A conventional electrical connector for a flat conductive member is mounted to a circuit board to connect the circuit board and the flat conductive member such as a flexible printed circuit board (FPC), a flexible flat cable (FFC), and the likes. As an example of the conventional electrical connector for a flat conductive member, an electrical connector in which a pressing member is provided has been known. The pressing member is operated between an open position to receive the flat conductive member and a closed position to press the flat conductive member to a contact portion of a terminal. In such an electrical connector, the pressing member is supported to be rotatable around a rotation shaft of the pressing member, so that the pressing member moves between the open position and the closed position through a rotation.

For example, Patent Reference has disclosed an electrical connector to which a pressing member having a lid shape is attached to an opening portion of a housing thereof to be rotatable.

Patent Reference Japanese Patent Publication No. 08-195256

In the electrical connector disclosed in Patent Reference, a locking portion having a shaft shape is provided on both ends of the pressing member in a terminal arrangement direction. The locking portion protrudes outside a terminal arrangement range in the terminal arrangement direction. The locking portion is retained in a locking groove portion that is formed in a housing to be rotatable.

A rotation supporting portion having a projected circular arc shape is fitted in a rotation groove portion having a recessed circular arc shape to be rotatable inside the terminal arrangement range. The rotation supporting portion having a projected circular arc shape is formed in a contact of each terminal. The rotation groove portion having a recessed circular arc shape is formed in the pressing member.

More specifically, the rotation groove portion engages with the rotation supporting portion that is positioned in an upper portion from below and is not supported from below. As described above, the pressing member is supported to be rotatable by the locking groove portion of the housing on both ends in the terminal arrangement range and by the rotation supporting portion of the terminal inside the terminal arrangement range.

In the electrical connector disclosed in Patent Reference, a sucking surface is formed as a horizontal plane on a top face of the pressing member at the open position, so that the sucking surface is sucked to a lower edge opening of a suction member of an automatic assembling device.

In the electrical connector disclosed in Patent Reference, the pressing member is supported on both edge portions outside the terminal arrangement range. Further, the pressing member is not supported inside the terminal arrangement range from below. Accordingly, when the lower edge opening of the suction member applies an excessive load to the sucking surface from above upon an automatic mounting by a suction conveyer, the pressing member may be displaced (moved or deformed), thereby making the suction operation unstable. In particular, when the pressing member has a large width in the terminal arrangement direction, the suction member tends to apply an excessive load and the suction operation becomes unstable.

In view of the problems described above, an objective of the present invention is to provide an electrical connector for a flat conductive member. In the electrical connector of the present invention, even when a suction member applies an excessive load to a sucking surface of a pressing member from above, the pressing member is not displaced, thereby achieving a stable suction operation.

Further objects and advantages of the invention will be apparent from the following description of the invention.

SUMMARY OF THE INVENTION

In order to attain the objects described above, according to the present invention, an electrical connector for a flat conductive member includes a housing, a plurality of terminals with at least one type, and a pressing member. The housing is arranged on a circuit board at a bottom surface thereof and is provided with an opening portion opened upwardly for receiving a flat conductive member. A plurality of terminals each having a contact portion situated in the opening portion is arranged in the housing. The pressing member is provided in the opening portion so as to be movable between an open position and a closed position.

The flat conductive member is inserted or removed through the opening portion when the pressing member is situated at the open position. The flat conductive member inserted in the opening portion is pressed to the contact portion when the pressing member is situated at the closed position. A sucking surface is formed on a surface of the pressing member in parallel to the bottom surface of the housing, so that a suction member operates downwardly and sucks the sucking surface when the pressing member is situated at the open position.

According to the present invention, the pressing member of the electrical connector has a shaft portion at a position corresponding to the terminals along a terminal arrangement direction. The shaft portion works together with the terminals when the pressing member moves. The shaft portion includes a guided portion and an abutting portion with a supported surface formed thereon. The guided portion is rotated and guided with the terminals when the pressing member moves. The supported surface receives a reaction force from the terminals when a pressure is applied from the suction member when the pressing member is situated at the open position.

According to the present invention, each of the terminals has a guide portion and a supporting portion. The guide portion guides the guided portion of the shaft portion. The supporting portion supports the supported surface of the abutting portion when the pressing member is situated at the open position.

In the electrical connector for a flat conductive member described above, when the suction member sucks the electrical connector for automatically mounting with a suction conveyer, the supported surface that is formed in the abutting portion of the shaft portion of the pressing member is supported by the supporting portion of the terminal. Accordingly, even when the suction member applies an excessive load from above to the sucking surface of the pressing member at the open position, the pressing member is not displaced. That is, a position and posture of the pressing member is unchanged and stable. Further, the supported surface of the abutting portion is supported with the supporting portion of the terminal at the open position. Accordingly, the pressing member is not moved to the closed position in a reverse direction by mistake.

According to the present invention, it is preferred that the terminal has a regulating portion. The regulating portion regulates an excessive movement of the pressing member over the closed position when the pressing member moves to the closed position. Further, it is preferred that the shaft portion of the pressing member has a regulated surface corresponding to the regulating portion for abutting against the regulating portion of the terminal at the closed position.

Accordingly, even if an excessive operating force is applied to the pressing member when the pressing member is moved to the closed position from the open position, the regulated surface of the pressing member abuts against the regulating portion of the terminal, thereby stopping the pressing member at the specific closed position. As a result, it is possible to prevent the pressing member and consequently the electrical connector from being damaged due to an excessive movement of the pressing member.

According to the present invention, it is preferred that the guided portion and the abutting portion of the shaft portion of the pressing member is formed to be continuous to each other on each cross-section taken along a plane perpendicular to the terminal arrangement direction.

Note that it is possible to provide the guided portion and the abutting portion to be separated on each cross-section taken along a plane perpendicular to the terminal arrangement direction. When the guided portion and the abutting portion are continued to each other, it is possible to simplify a shape of the shaft portion, thereby making it easy to design the shaft portion and consequently the pressing member. Further, the shaft portion and the abutting portion reinforce each other, thereby improving strength thereof.

According to the present invention, the terminals may be of more than one types having different shapes. Accordingly, one type of terminal is not restricted by a shape of another type of terminal, thereby improving a degree of freedom with respect to a design of the terminals.

According to the present invention, it is preferred that various types of terminals are arranged in addition to the terminals with the one type. The guide portion of the terminal with the one type regulates the guided portion of the shaft portion of the pressing member in a top-to-bottom direction. The pressing member has a sub shaft portion at a position corresponding to the terminals of the various types in the terminal arrangement direction. The sub shaft portion is provided at the same position as the guided position that is viewed from the terminal arrangement direction. Further, the terminals of the various types are provided with two regulating guide portions that regulate the sub shaft portion of the pressing member in a horizontal direction on both sides of the sub shaft portion in the horizontal direction.

Accordingly, the guided portion of the shaft portion of the pressing member is regulated by the guide portion of the terminal in the top-to-bottom direction at the position corresponding to the terminal of one type in the terminal arrangement direction. Further, the sub shaft portion is regulated by a regulating guide arm portion of the terminal in the horizontal direction at a position corresponding to the terminals of the various types. Accordingly, the guided portion and the sub shaft portion are guided by the terminal substantially all around a periphery thereof. The guided portion and the sub shaft portion are situated at the same position when viewed in the terminal arrangement direction. As a result, the pressing member is prevented from coming off in all directions due to guidance of the terminals.

According to the present invention, it is preferred that the supporting portion of the terminal of the one type has a horizontal portion. Further, the guide portion of the terminal may extend from the supporting portion. The guided portion of the shaft portion may have a contact surface that contacts with the guide portion of the terminal at the open position and contacts with the supporting portion of the terminal at the closed position.

Accordingly, when the pressing member moves, the contact surface of the guided portion is guided by the guide portion of the terminal and the supporting portion. Further, the guided portion may have a rotational movement around a rotation center along with a linear movement of the rotation center of the guided portion along the guide portion. That is, a movement of the pressing member is not limited to a rotational movement around the rotation shaft that is fixed, which improves the degree of freedom of the design.

According to the present invention, it is preferred that the guided portion of the shaft portion has a projected curved portion on the contact surface thereof. The guide portion of the terminal may have a first recessed curved portion. The first recessed curved portion engages with the projected curved portion at the open position and with an edge portion of the guided portion at the closed position.

Further, the supporting portion of the terminal may have a second recessed curved portion. The second recessed curved portion engages with the projected curved portion at the closed position. Accordingly, the projected curved portion of the shaft portion engages with the first recessed curved portion of the terminal at the open position.

Further, the edge portion of the shaft portion engages with the first recessed curved portion of the terminal, and the projected curved portion of the shaft portion engages with the second recessed curved portion of the terminal at the closed position. Accordingly, it is possible to stabilize the shaft portion and consequently the pressing member at the open position and the closed position.

In the present invention, when the pressing member is situated at the open position, the supported surface is supported by the supporting surface. The supported surface is formed in the abutting portion of the shaft portion. The supporting surface is formed in the terminal.

When the suction member applies an excessive load to the sucking surface of the pressing member upon the automatic mounting by the suction conveyer, the pressing member is not displaced due to the support from the supporting surface. That is, even if the suction member applies an excessive load, a position and a posture of the pressing member is unchanged and stable, thereby securely sucking the electrical connector.

Further, the supported surface of the abutting portion is supported by the supporting portion of the terminal at the open position. Accordingly, the pressing member is not moved to the closed position in the reverse direction. That is, even if the force in the reverse direction is applied to the pressing member by mistake, the pressing member, and consequently the connector, are not damaged.

BRIEF DESCRIPTION OF THE DRAWINGS

FIGS. 2(A) and 2(B) are sectional views showing the connector taken along a plane perpendicular to a terminal arrangement direction in a state that the pressing member is situated at the open position according to the first embodiment of the present invention, wherein FIG. 2(A) is a sectional view at a position of a first terminal in the terminal arrangement direction, and FIG. 2(B) is a sectional view at a position of a second terminal in the terminal arrangement direction;

FIGS. 3(A) and 3(B) are sectional views showing the connector taken along a plane perpendicular to the terminal arrangement direction when the pressing member moves from the open position to a closed position according to the first embodiment of the present invention, wherein FIG. 3(A) is a sectional view at the position of the first terminal in the terminal arrangement direction, and FIG. 3(B) is a sectional view at the position of the second terminal in the terminal arrangement direction;

FIGS. 4(A) and 4(B) are enlarged sectional views showing the pressing member around a rotation center thereof according to the first embodiment of the present invention, wherein FIG. 4(A) is an enlarged sectional view in the state that the pressing member is situated at the open position, and FIG. 4(B) is an enlarged sectional view in the state that the pressing member is situated at the closed position;

FIGS. 5(A) and 5(B) are sectional views showing a connector taken along a plane perpendicular to a terminal arrangement direction in a state that a pressing member is situated at an open position according to a second embodiment of the present invention, wherein FIG. 5(A) is a sectional view at a position of a first terminal in the terminal arrangement direction, and FIG. 5(B) is a sectional view at a position of a second terminal in the terminal arrangement direction;

FIGS. 6(A) and 6(B) are sectional views showing the connector taken along a plane perpendicular to the terminal arrangement direction when the pressing member moves from the open position to a closed position according to the second embodiment of the present invention, wherein FIG. 6(A) is a sectional view at the position of the first terminal in the terminal arrangement direction, and FIG. 6(B) is a sectional view at the position of the second terminal in the terminal arrangement direction; and FIGS. 7(A) and 7(B) are enlarged sectional views showing the pressing member around a rotation center thereof according to the second embodiment of the present invention, wherein FIG. 7(A) is an enlarged sectional view in the state that the pressing member is situated at the open position, and FIG. 7(B) is an enlarged sectional view in the state that the pressing member is situated at the closed position.

DETAILED DESCRIPTION OF PREFERRED EMBODIMENTS

Hereunder, embodiments of the present invention will be explained with reference to the accompanying drawings.

First Embodiment

Figure 1:
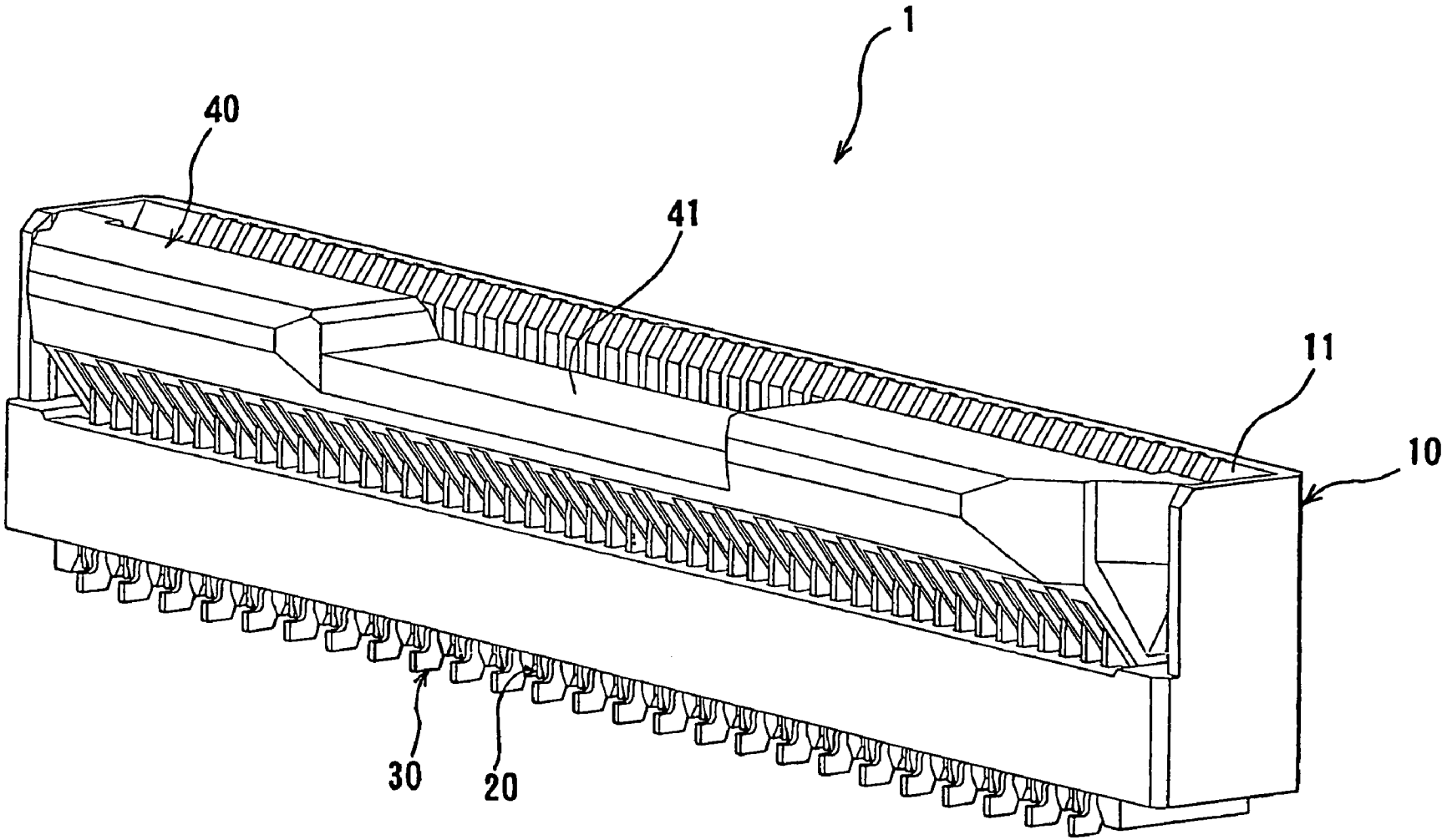
FIG. 1 is a perspective view showing an electrical connector for a flat conductive member in a state that a pressing member is situated at an open position according to a first embodiment of the present invention.

A first embodiment of the present invention will be explained. FIG. 1 is a perspective view showing an electrical connector 1 for a flat conductive member according to the first embodiment of the present invention. A bottom surface of the electrical connector 1 for a flat conductive member (hereinafter called "connector 1") is arranged on a circuit board (not shown). Further, the connector 1 receives a flat conductive member (not shown) having a band shape to electrically connect the flat conductive member to the circuit board.

In the embodiment, the connector 1 includes a housing 10, first terminals 20, second terminals 30, and a pressing member 40. The first terminal 20 and the second terminal 30 are arranged and held with the housing 10 and have different shapes. The pressing member 40 is held with the first terminals 20 and the second terminals 30 to be rotatable. The first terminal 20 and the second terminal 30 may be collectively called "terminal".

The housing 10 has an approximate rectangular parallelepiped outer shape. The housing 10 is formed of a synthetic resin that is an electrically insulating member. An opening portion 11 is formed in the housing 10 for receiving the flat conductive member. The opening portion 11 opens upward. Each of the terminals 20 and the terminals 30 is formed of a metal sheet.

As shown in FIG. 1, the terminals 20 and the terminals 30 are arranged and held in the housing 10 at a specific interval. Surfaces of the terminal 20 the terminal 30 are parallel to each other.

In the embodiment, the first terminals 20 and the second terminals 30 are alternatively arranged and held in the housing 10. It should be noted that the terminals 20 and the terminals 30 do not have to be arranged alternatively. Instead, the terminal 20 and the terminal 30 may be arranged irregularly. For example, the terminals 20 and the terminals 30 may be mixed irregularly in a terminal arrangement direction.

In the embodiment, the pressing member 40 is provided in the opening portion 11. As described below, the pressing member 40 is rotatable between an open position and a closed position. The flat conductive member can be inserted in or pulled out from the opening portion 11 of the housing 10 at the open position. The flat conductive member that is inserted in the opening portion 11 is pressed to a contact portion of the terminal 20 and the terminal 30 at the closed position.

FIG. 1 shows a state in which the pressing member 40 is at the open position. As shown in FIG. 1, when the pressing member 40 is at the open position, a sucking surface 41 is situated on a top face thereof. The sucking surface 41 is formed to be a horizontal plane that is lower than the other areas in a center area of the pressing member 40 in the terminal arrangement direction.

In the embodiment, the sucking surface 41 is formed in the center area of the pressing member 40 in the terminal arrangement direction, and the first terminals 20 and the second terminals 30 are randomly arranged at least in an area of the sucking surface 41.

Figure 2:
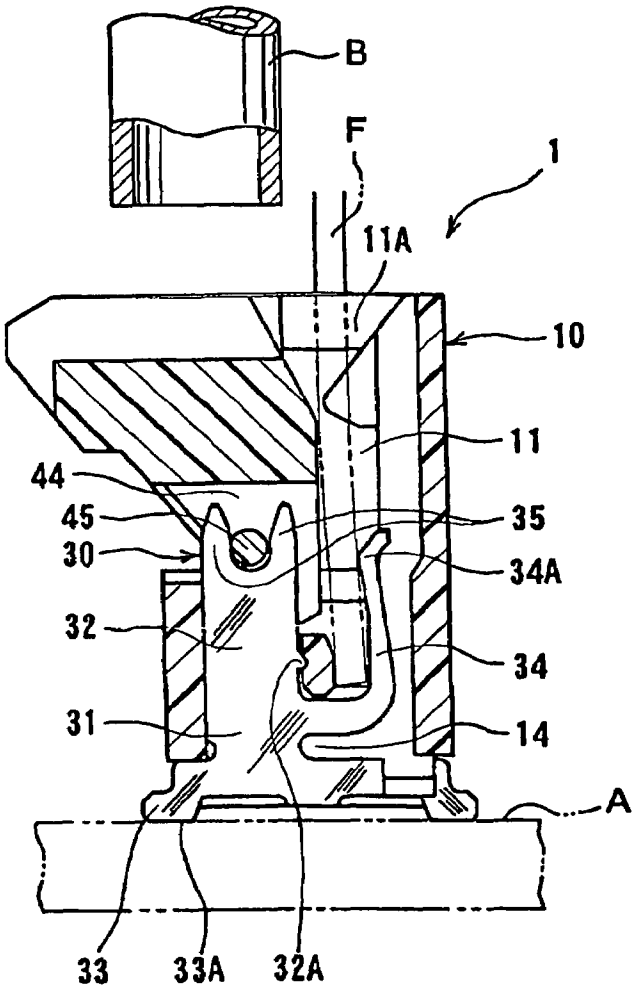
Figure 2:
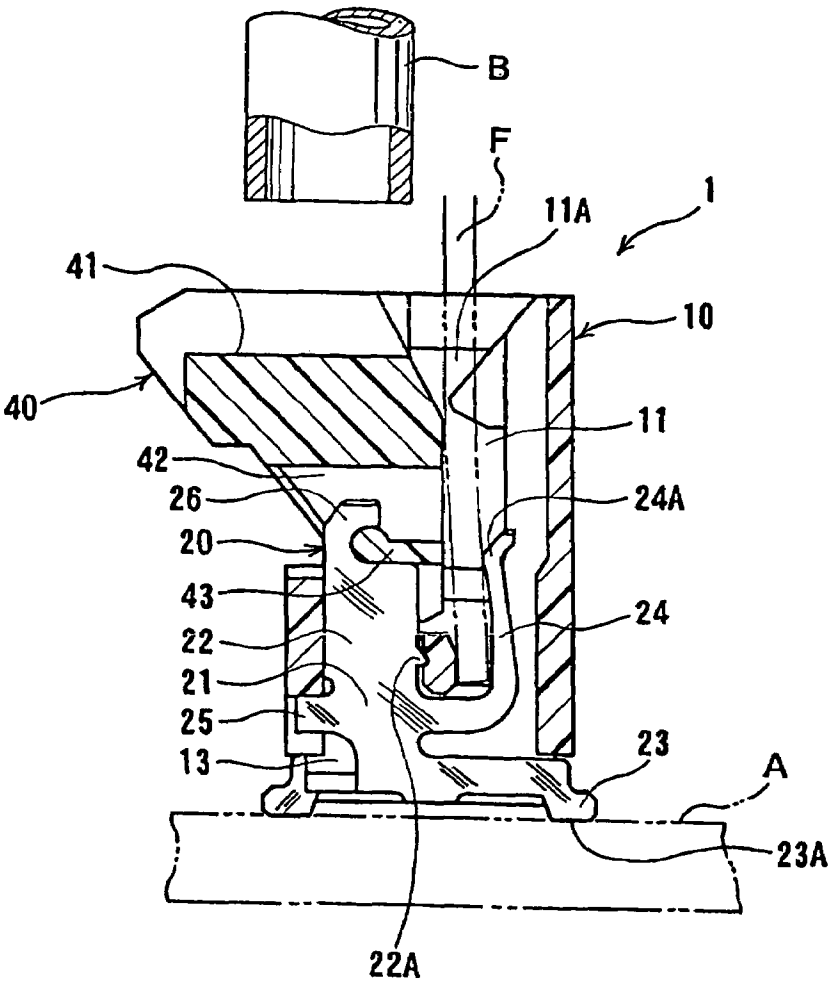

FIGS. 2(A) and 2(B) are sectional views showing the connector 1 taken along a plane perpendicular to the terminal arrangement direction in a state that the pressing member 40 is situated at the open position according to the first embodiment of the present invention. More specifically, FIG. 2(A) is a sectional view at a position of the first terminal 20 in the terminal arrangement direction, and FIG. 2(B) is a sectional view at a position of the second terminal 30 in the terminal arrangement direction.

Figure 3:
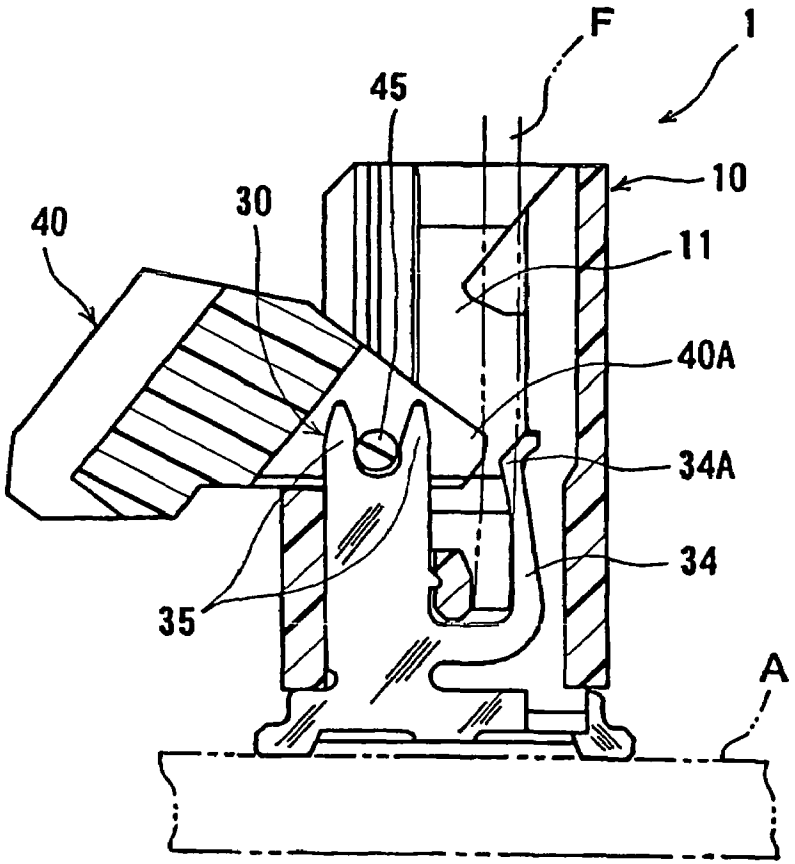
Figure 3:
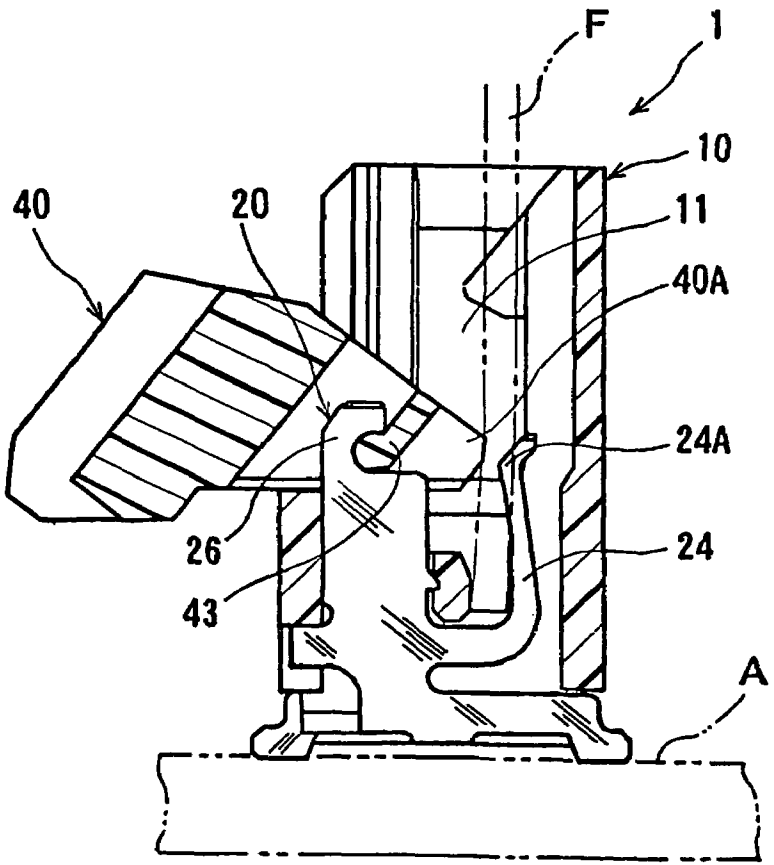

FIGS. 3(A) and 3(B) are sectional views showing the connector 1 taken along a plane perpendicular to the terminal arrangement direction when the pressing member 40 moves from the open position shown in FIGS. 2(A) and 2(B) to the closed position according to the first embodiment of the present invention. More specifically, FIG. 3(A) is a sectional view at the position of the first terminal 20 in the terminal arrangement direction, and FIG. 3(B) is a sectional view at the position of the second terminal 30 in the terminal arrangement direction.

As shown in FIGS. 2(A) and 2(B), the opening portion 11 is formed in the housing 10 at a position corresponding to the first terminals 20 and the second terminals 30 in the terminal arrangement direction. The opening portion 11 opens upward and extends downward. Further, the opening portion 11 communicates in a terminal arrangement range in the terminal arrangement direction or a direction perpendicular to a sheet surface.

In the embodiment, an insertion port 11A is formed in a top portion of the housing 10, so that a flat conductive member F (indicated by phantom lines in FIGS. 2(A) and 2(B)) can be received from above in the housing 10.

The housing 10 is provided with first terminal receiving grooves 13 and second terminal receiving grooves 14 (collectively called "terminal receiving grooves") in an area on a left side of the opening portion 11. The first terminal receiving grooves 13 and the second terminal receiving grooves 14 hold the first terminals 20 and the second terminals 30, respectively.

In the embodiment, the first terminal receiving grooves 13 and the second terminal receiving grooves 14 extend in parallel to a sheet surface, or in parallel to plate surfaces of the first terminals 20 and the second terminals 30. The first terminal receiving grooves 13 and the second terminal receiving grooves 14 have a groove width (a width in a direction perpendicular to a sheet surface) substantially the same as a plate thickness of the first terminals 20 and the second terminals 30 formed of the metal sheet, respectively.

In the embodiment, the first terminal receiving grooves 13 and the second terminal receiving grooves 14 are alternatively arranged corresponding to the first terminals 20 and the second terminals 30 in a direction perpendicular to the sheet surface, respectively. The first terminal receiving grooves 13 and the second terminal receiving grooves 14 open downward, so that the first terminals 20 and the second terminals 30 are inserted therein from below, respectively.

As shown in FIG. 2(A), each of the first terminals 20 comprises an attached portion 22, a connection portion 23, a contact arm 24, a locking portion 25, and a rotation supporting portion 26. The attached portion 22 is formed to extend upward from a base portion 21. Further, the attached portion 22 is press-fitted into the first terminal receiving groove 13 when the first terminal 20 is attached to the housing 10.

In the embodiment, the connection portion 23 is formed in a crank shape bending from a lower portion to a right portion, and further to a lower portion of the base portion 21. The contact arm 24 protrudes toward a right side of the base portion 21 above the connection portion 23, and is bent to extend upward. The locking portion 25 protrudes toward a left side of the base portion 21. The rotation supporting portion 26 protrudes upward from a left side area of an upper edge of the attached portion 22. Further, the rotation supporting portion 26 is provided with a recessed curved portion on a right edge thereof.

A protrusion 22A is formed on a right side edge portion of the attached portion 22. When the first terminal 20 is press-fitted into the first terminal receiving groove 13 from below, the protrusion 22A bites into an inner surface of the first terminal receiving groove 13 so as to be securely held. The connection portion 23 is situated outside of the housing 10. When the connector 1 is mounted to a circuit board A (indicated by a phantom line in FIG. 2(A)), a lower edge 23A of the connection portion 23 is soldered to a corresponding circuit portion of the circuit board A.

A distal portion of a part of the contact arm 24 that extends upward forms a contact portion 24A. The contact portion 24A has a protruding shape that is bent to a left side. The contact portion 24A is positioned in a right side area inside of the opening portion 11. The flat conductive member F (indicated by another phantom line in FIG. 2(A)) is inserted in the opening portion 11 from the insertion port 11A. The flat conductive member F enters between the attached portion 22 and the contact arm 24 while being guided by the pressing member (explained below). A connection circuit portion (not shown) that is formed in the flat conductive member F is brought into light contact with the contact portion 24A of the contact arm 24.

The locking portion 25 protrudes from a left side of the base portion 21. When the attached portion 22 of the first terminal 20 is press-fitted into the first terminal receiving groove 13, the locking portion 25 abuts against a corresponding edge of the housing 10 to position the first terminal 20.

As shown in FIGS. 2(A) and 2(B), the pressing member 40 has a sucking surface 41 when the pressing member 40 is situated at the open position. The sucking surface 41 forms a horizontal plane and is sucked by a suction member B for suction transportation. As described above, the sucking surface 41 is formed in a center area of the pressing member 40 in the terminal arrangement direction (shown in FIG. 1).

In the embodiment, a groove portion 42 is formed at a position that corresponds to the first terminals 20 in the terminal arrangement direction below the sucking surface 41 in the pressing member 40. The groove portion 42 allows the rotation supporting portion 26 of the first terminal 20 to enter. A shaft portion 43 having an island shape is formed in a bottom portion of the groove portion 42 so as to connect inner surfaces of the groove portion 42.

In the embodiment, a groove portion 44 is formed at a position that corresponds to the second terminals 30 in the terminal arrangement direction below the sucking surface 41. The groove portion 44 allows a part of the second terminal 30 to enter. A sub shaft portion 45 having an island shape is formed in a bottom portion of the groove portion 44 so as to connect inner surfaces of the groove portion 44.

A relationship between the pressing member 40 and the first terminal 20 will be explained with reference to FIGS. 4(A) and 4(B).

Figure 4:
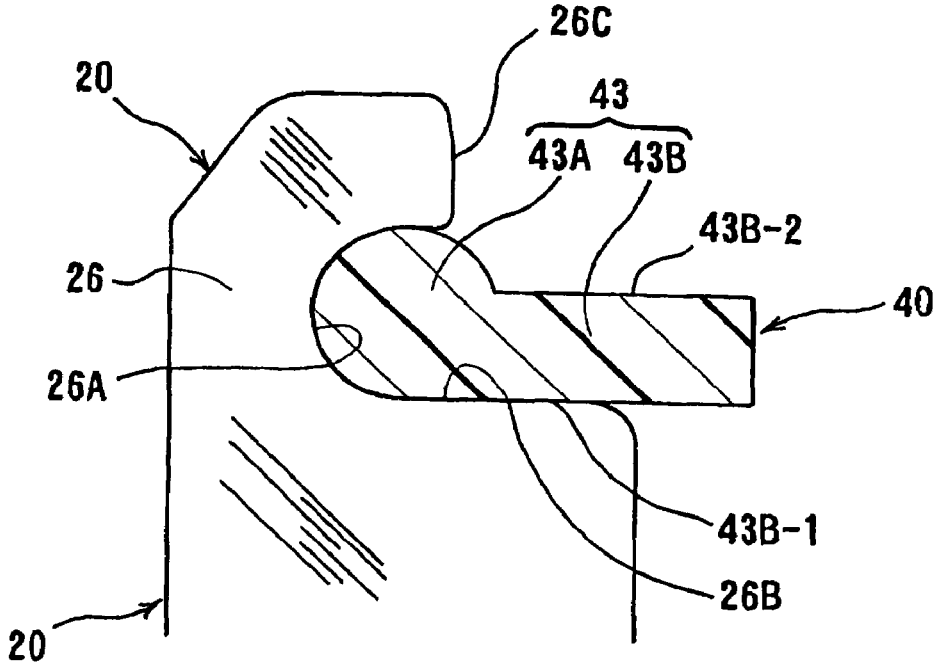
Figure 4:
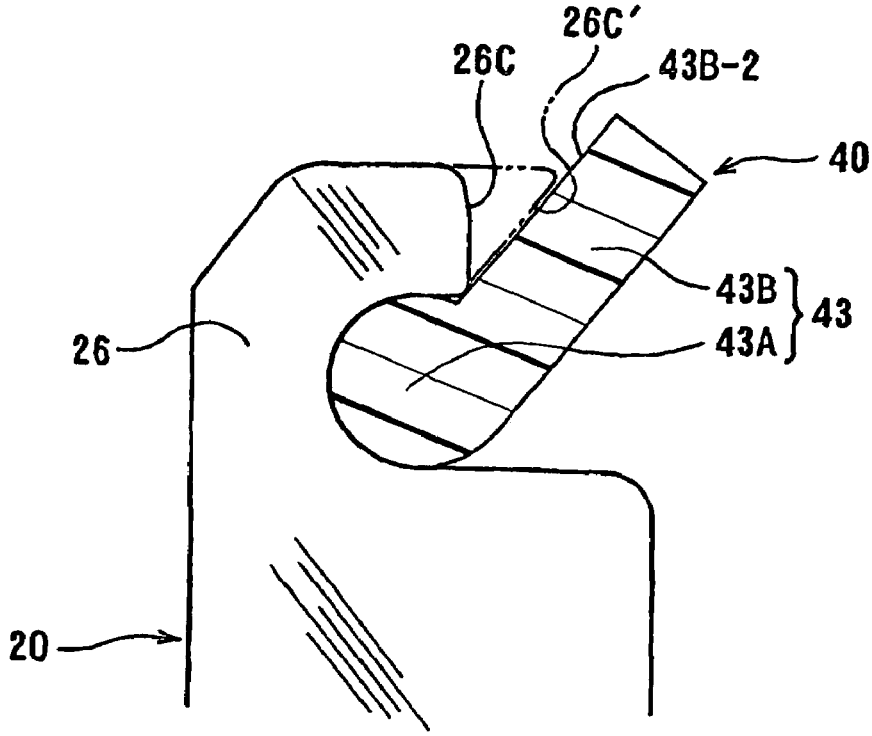

FIGS. 4(A) and 4(B) are enlarged sectional views showing the pressing member 40 around a rotation center thereof according to the first embodiment of the present invention. More specifically, FIG. 4(A) is an enlarged sectional view in the state that the pressing member 40 is situated at the open position, and FIG. 4(B) is an enlarged sectional view in the state that the pressing member 40 is situated at the closed position.

As shown in FIG. 4(A), the rotation supporting portion 26 of the first terminal 20 has a guide portion 26A, a supporting portion 26B, and a regulating portion 26C each disposed on an inner edge thereof. The guide portion 26A is formed of an inner edge of the rotation supporting portion 26, and is bent in an approximate C-character shape. The supporting portion 26B is formed to extend to a right side of the rotation supporting portion 26 horizontally from a lower edge of the guide portion 26A. The regulating portion 26C is formed to extend upward from an upper edge of the guide portion 26A.

As described below, the guide portion 26A slides to guide a guided portion 43A of the shaft portion 43 when the pressing member 40 is rotated between the open position and the closed position. The shaft portion 43 is a rotation center of the pressing member 40. Further, the guide portion 26A regulates the shaft portion 43 of the pressing member 40 in a top-to-bottom direction on upper and lower edges thereof. The supporting portion 26B and the regulating portion 26C will be explained later.

The second terminal 30 will be explained in relation to the pressing member 40. As shown in FIG. 2(B), the second terminal 30 has an attached portion 32, a connection portion 33, a contact arm 34, and regulating guide portions 35. The attached portion 32 is formed to extend upward from a base portion 31 and is press-fitted into the second terminal receiving groove 14 when the second terminal 30 is attached to the housing 10. The connection portion 33 extends below and to a left side of the base portion 31 in a crank shape. The contact arm 34 extends to a right side and then upward from the base portion 31. The regulating guide portion 35 extends upward from the attached portion 32 to sandwich the sub shaft portion 45 of the pressing member 40. The regulating guide portions 35 are in a shape of two arms that are positioned on both sides of the sub shaft portion 45 in a horizontal direction.

A protrusion 32A is formed on a right side edge portion of the attached portion 32. When the second terminal 30 is pressed-fit into the second terminal receiving groove 14 from below, the protrusion 32A bites into an inner surface of the second terminal receiving groove 14 so as to be securely held. The connection portion 33 is positioned outside of the housing 10. When the connector 1 is mounted to the circuit board A (indicated by a phantom chain line in FIG. 2(B)), a lower edge 33A thereof is soldered to a corresponding circuit portion of the circuit board A.

A distal portion of a part of the contact arm 34 that extends upward forms a contact portion 34A. The contact portion 34A has a protruding shape that is bent to a left side. The contact portion 34A is positioned in a right side area inside of the opening portion 11. The flat conductive member F (indicated by another phantom line in FIG. 2(B)) is inserted in the opening portion 11 from the insertion port 11A. The flat conductive member F enters between the attached portion 32 and the contact arm 34 while being guided by the pressing member. A connection circuit portion (not shown) that is formed in the flat conductive member F is brought into light contact with the contact portion 34A of the contact arm 34.

In the embodiment, the regulating guide portions 35 form a groove. The groove has an inner edge that is curved in a circular ark shape on a bottom portion thereof. As described below, when the pressing member 40 is rotated between the open position and the closed position, an inner edge of the regulating guide portions 35 guides the sub shaft portion 45 of the pressing member 40. The sub shaft portion 45 of the pressing member 40 becomes a rotation center.

When the pressing member 40 is rotated between the open position and the closed position, the regulating guide portions 35 regulate the sub shaft portion 45 of the pressing member 40 in a horizontal direction. The sub shaft portion 45 of the pressing member 40 is positioned between the regulating guide portions 35.

The shaft portion 43 and the sub shaft portion 45 of the pressing member 40 will be explained in relation to the first terminals 20 and the second terminals 30.

The shaft portion 43 corresponds to the first terminal 20 of the pressing member 40. As shown in FIG. 4(A), the shaft portion 43 has a portion that constitutes an outer edge having substantially the same shape as the guide portion 26A that is formed in the rotation supporting portion 26 of the terminal 20.

Further, the shaft portion 43 has the guided portion 43A and an abutting portion 43B. The guided portion 43A is engaged with the guide portion 26A. The abutting portion 43B extends to a right side from the guided portion 43A and has a straight shape. The guided portion 43A is provided in the same position as that of the sub shaft portion 45 of the pressing member 40 when seen from a terminal arrangement direction.

The sub shaft portion 45 of the pressing member 40 is positioned to correspond to the second terminal 30. That is, the guided portion 43A of the shaft portion 43 and the sub shaft portion 45 have a common rotation axis line at the same position. When the pressing member 40 is situated at the open position, the abutting portion 43B has a supported surface 43B-1 and a regulated surface 43B-2. The supported surface 43B-1 is formed of a lower surface of the abutting portion 43B. The regulated surface 43B-2 is formed of a top surface of the abutting portion 43B.

As shown in FIG. 4(A), when the pressing member 40 is situated at the open position, the supported surface 43B-1 is adjacent to the supporting portion 26B of the terminal.

In the embodiment, the guided portion 43A and the abutting portion 43B are connected to with each other. Alternatively, the guided portion 43A and the abutting portion 43B may be formed separately. The shapes of the guided portion 43A and the abutting portion 43B are simplified when the guided portion 43A and the abutting portion 43B are. Further, when the guided portion 43A and the abutting portion 43B are connected, the guided portion 43A and the abutting portion 43B reinforce each other to prevent a lowering of strength as a whole.

An operation of assembling the connector 1 will be explained next. After the assembly, the connector 1 is mounted with an automated machine.

First, the housing 10, the first terminals 20 and the second terminals 30 of a specific number, and the pressing member 40 are prepared. Then, the first terminals 20 are inserted in the first terminal receiving grooves 13 of the housing 10 from below. In this step, the attached portion 22 of the first terminal 20 is press-fitted into the first terminal receiving groove 13. Accordingly, the protrusion 22A bites into the inner surface of the first terminal receiving groove 13 to prevent the terminal 20 from coming off.

In the next step, the pressing member 40 is incorporated. More specifically, the guided portion 43A of the shaft portion 43 of the pressing member 40 engages with the guide portion 26A of the first terminal 20 while the pressing member 40 rises upward to be at the open position.

In the next step, the second terminals 30 are inserted in the second terminal receiving grooves 14 of the housing 10 from below. In this step, the attached portion 32 of the second terminal 30 is press-fitted into the second terminal receiving groove 14. Accordingly, the protrusion 32A bites into an inner surface of the second terminal receiving groove 14 to prevent the terminal 30 from coming off. The sub shaft portion 45 of the pressing member 40 is stored between the regulating guide portions 35 of the second terminals 30.

In the connector 1 described above, a movement of the guided portion 43A of the pressing member 40 in a vertical direction and to a left side is regulated by the guide portion 26A of the first terminal 20 at the position of the first terminals 20 in the terminal arrangement direction. A movement of the sub shaft portion 45 of the pressing member 40 in a horizontal direction is regulated by the regulating guide arm portion 35 of the second terminal 30 at the position of the second terminals 30 in the terminal arrangement direction.

Accordingly, the first terminals 20 and the second terminals 30 enable to regulate the movement of the guided portion 43A and the sub shaft portion 45 that are situated at the same position when viewed in the terminal arrangement direction over substantially the entire circumference thereof. As a result, the pressing member 40 is prevented from coming off in all directions.

In the embodiment, the connector 1 is suitable for an automatic mounting in which the connector 1 is transported to the circuit board with the suction member. When the connector 1 is sucked, a lower edge opening of a suction member B as shown in FIGS. 2(A) and 2(B) approaches to a horizontal top face of the pressing member 40 at the open position or the sucking surface 41 from above to contact the sucking surface 41. Alternatively, the lower edge opening of the suction member B may be positioned near the sucking surface 41 to suck the connector 1. After the connector 1 is sucked with the suction member B to be on the circuit board, the connector 1 is released from the suction force and arranged in a specific position on the circuit board.

As described above, the suction member B normally sucks to lift the connector 1 with the suction force 41 when contacting or approaching the sucking surface 41. Accordingly, the connector 1 does not receive the downward load from the suction member B. However, it is possible that the sucking surface 41 is loaded from above when the lower edge opening of the suction member B contacts with the sucking surface 41 of the connector 1 due to various factors such as a condition of a suction conveyer or an environment.

As shown in FIGS. 4(A) and 4(B), in the embodiment, when the pressing member 40 is situated at the open position, the supported surface 43B-1 of the shaft portion 43 is adjacent to and supported by the supporting portion 26B of the terminal 20. Accordingly, even if the pressing member 40 is loaded as described above, the supported surface 43B-1 of the shaft portion 43 can support a reaction force from the supporting portion 26B of the terminal.

Accordingly, in the electrical connector 1 for a flat conductive member with the above configuration, even if the lower edge opening of the suction member B applies an excessive load to the sucking surface 41 of the pressing member 40 at the open position from above when the connector 1 is automatically sucked through a suction conveyer, the supported surface that is formed in the abutting portion of the shaft portion of the pressing member 40 is supported by the supporting portion of the terminal, thereby preventing the pressing member 40 from displacing. That is, even if the pressing member 40 is loaded with the suction member, a position and posture of the pressing member 40 do not change and are stable. Accordingly, it is possible to ensure the suction.

When the connector 1 described above is used, the pressing member 40 is positioned at the open position as shown in FIGS. 2(A) and 2(B). As indicated by the phantom lines in FIGS. 2(A) and 2(B), the flat conductive member F is inserted in the opening portion 11 of the housing 10 from the insertion port 11A thereof. The flat conductive member F is inserted between the attached portion 22 of the first terminal 20 and the contact arm 24 and between the attached portion 32 of the second terminal 30 and the contact arm 34 without difficulty, respectively. Further, the contact portions 24A of the first terminals 20 and the contact portions 34A of the second terminals 30 are brought into light contact with the respective corresponding connecting circuit portions of the flat conductive member F.

Next, the pressing member 40 is rotated to the closed position as shown in FIGS. 3(A) and 3(B). The pressing member 40 strongly presses the flat conductive member F with the pressing portion 40A thereof at the closed position. Accordingly, a contact pressure between the contact portions 24A of the first terminals 20 or the contact portions 34A of the second terminals 30 and the connection circuit portions of the flat conductive member F is increased. Accordingly, the electrical connection between the connector 1 and the flat conductive member F is ensured.

When the pressing member 40 is rotated to the closed position, as shown in FIG. 4(B), a part of the regulated surface 43B-2 of the shaft portion 43 and a part of the regulating portion 26C of the first terminal 20 are adjacent to each other at the position of the first terminals 20 in the terminal arrangement direction so as to regulate a further rotation of the pressing member 40. That is, even if an excessive operating force is applied to the pressing member 40 when the pressing member 40 is moved to the closed position, the pressing member 40 stops at the specific closed position. As a result, it is prevented that the pressing member 40 and consequently the connector 1 from being damaged due to an excessive movement of the pressing member 40.

Further, in the embodiment, a part of the regulated surface 43B-2 of the shaft portion 43 is adjacent to a part of the regulating portion 26C of the first terminal 20 at the closed position. As a variation, it is possible that the regulated surface 43B-2 of the shaft portion 43 may be adjacent to the entire surface of the regulating portion 26C of the first terminal 20. Further, the regulated surface 43B-2 may be adjacent to the regulating portion 26C on a large surface.

For example, as indicated by a phantom line in FIG. 4(B), a surface of the regulating portion 26C' may be formed as a slope so as to be in parallel with the regulated surface 43B-2 at the closed position.

In the embodiment, two types of terminals, i.e., the first terminals 20 and the second terminals 30, having different shapes are provided. As a variation, three types or more of terminals having different shapes may be provided. Accordingly, the degree of freedom of design of the connector is improved.

Second Embodiment

A second embodiment of the present invention will be explained next with reference to FIGS. 5(A)-5(B) to 7(A)-7(B).

In the first embodiment, the pressing member 40 is moved between at the open position and the closed position by only a rotation of the shaft portion at the specific position.

In the second embodiment shown in FIGS. 5(A)-5(B) to 7(A)-7(B), different from the first embodiment, a guided portion of a shaft portion of a pressing member includes a linear movement of a rotation center of the guided portion along the guide portion of a terminal in addition to a rotation around the rotation center in a movement of the pressing member between the open position and the closed position.

In the second embodiment, the shaft portion of the pressing member and a corresponding portion of the first terminal that engages with the shaft portion are different from those in the first embodiment. Accordingly, the shaft portion and the corresponding portion of the first terminal are focused and explained below. Components in the second embodiment similar to those in the first embodiment are designated with reference numbers corresponding to those in the first embodiment increased by 50, and explanations thereof are omitted.

Figure 5:
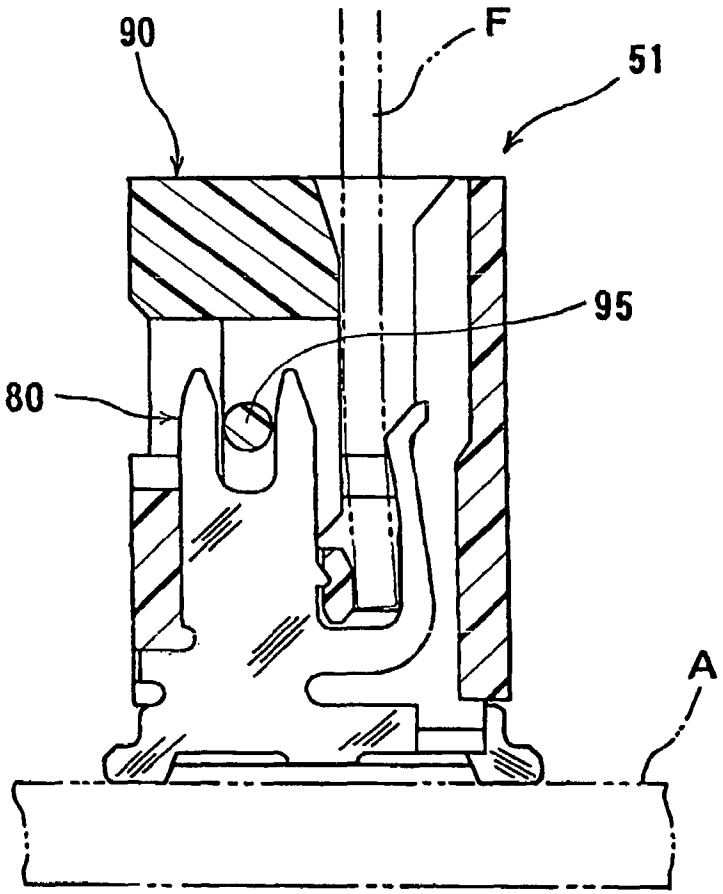
Figure 5:
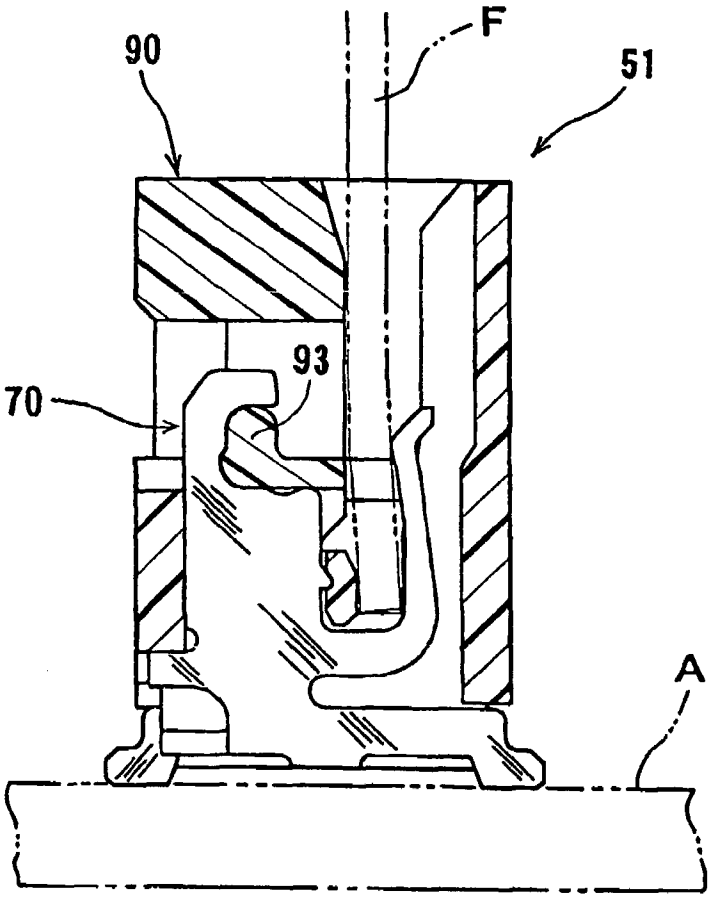

FIGS. 5(A)-5(B) to 7(A)-7(B) correspond to FIGS. 2(A)-2(B) to 4(A)-4(B) in the first embodiment. FIGS. 5(A) and 5(B) are sectional views showing a connector 51 taken along a plane perpendicular to a terminal arrangement direction when a pressing member 90 is situated at an open position according to the second embodiment of the present invention. More specifically, FIG. 5(A) is a sectional view of the connector 51 at a position of a first terminal 70 in the terminal arrangement direction, and FIG. 5(B) is a sectional view of the connector 51 at a position of a second terminal 80 in the terminal arrangement direction.

Figure 6:
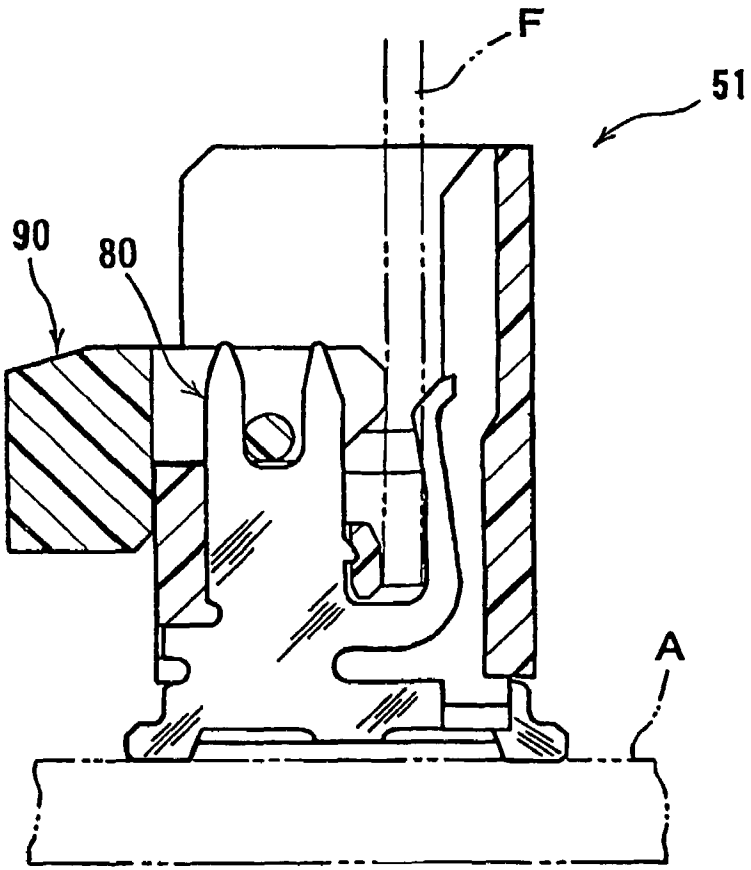
Figure 6:
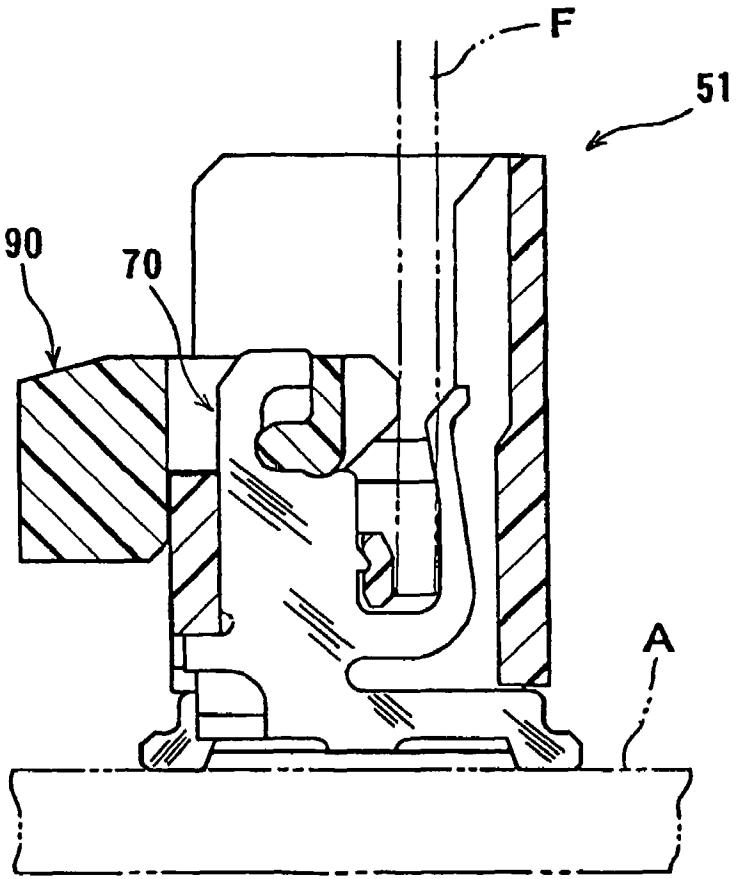

FIGS. 6(A) and 6(B) are sectional views showing the connector 51 taken along a plane perpendicular to the terminal arrangement direction when the pressing member 90 is situated at the closed position. More specifically, FIG. 6(A) is a sectional view of the connector 51 at the position of the first terminal 70 in the terminal arrangement direction, and FIG.

6(B) is a sectional view of the connector 51 at the position of the second terminal 80 in the terminal arrangement direction.

Figure 7:
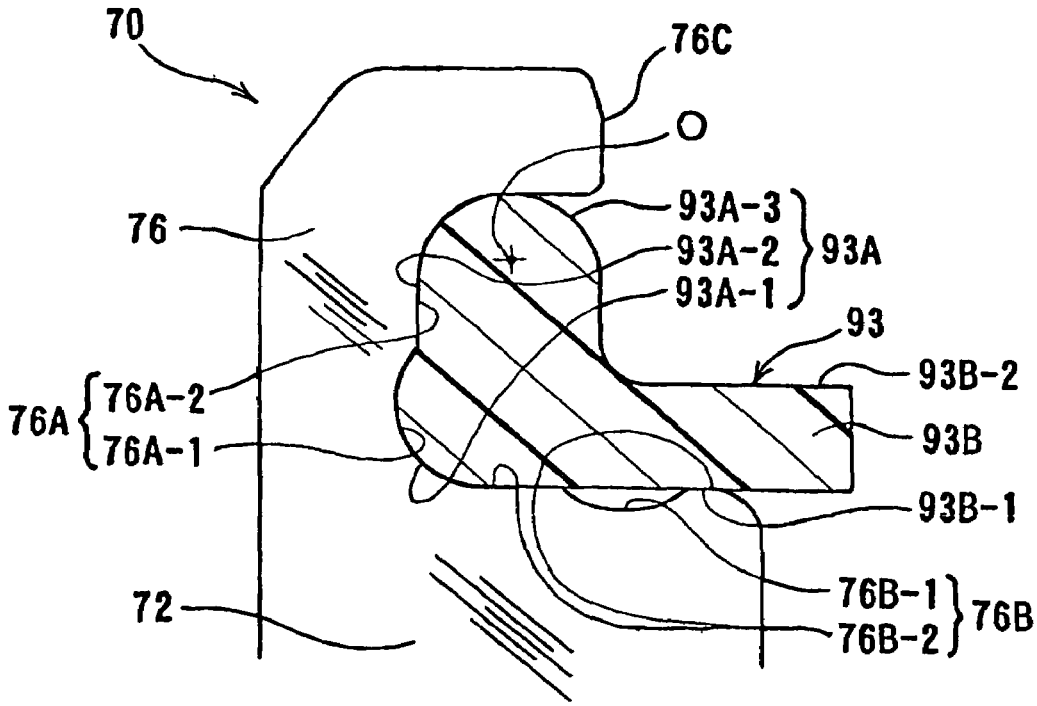
Figure 7:
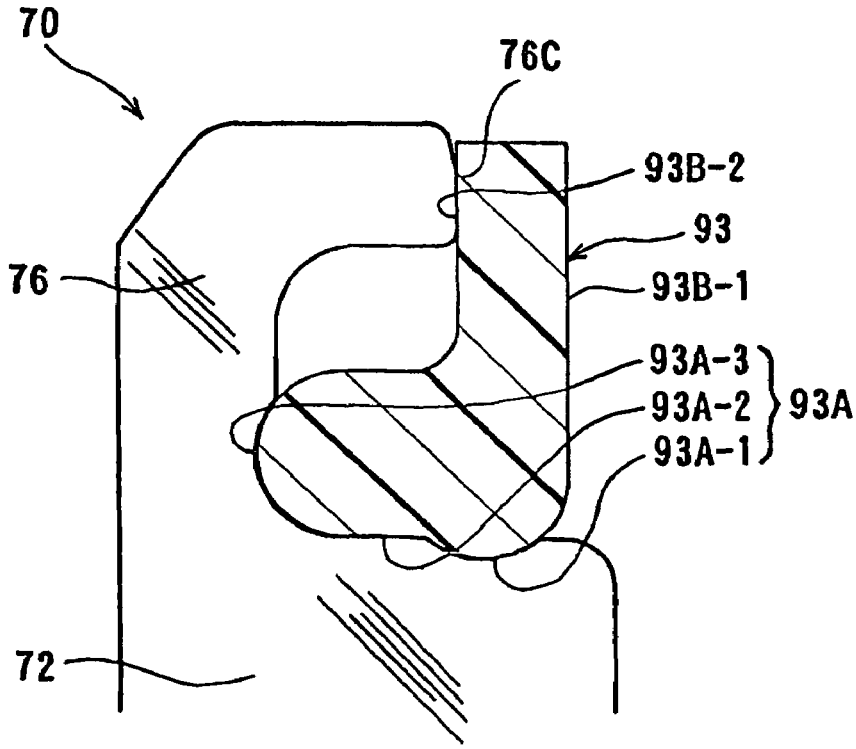

FIGS. 7(A) and 7(B) are enlarged sectional views showing the pressing member 90 around the rotation center thereof according to the second embodiment of the present invention. More specifically, FIG. 7(A) is an enlarged sectional view in the state that the pressing member 90 is situated at the open position, and FIG. 7(B) is an enlarged sectional view in the state that the pressing member 90 is situated at the closed position.

As shown in FIGS. 7(A) and 7(B), the first terminal 70 has a moving supporting portion 76. The moving supporting portion 76 protrudes upward from an upper left portion of the attached portion 72 and is then curved to a right side.

In the embodiment, the moving supporting portion 76 has a guide portion 76A, a supporting portion 76B, and a regulating portion 76C. The guide portion 76A constitutes an edge portion of a bottom portion area of a recess portion of the moving supporting portion 76. The recess portion is formed of an inner edge that is bent in an approximate hooked shape. The supporting portion 76B is formed of an edge portion that extends from a lower edge to a right side of the guide portion 76A. The regulating portion 76C is formed to extend upward from an upper edge of the guide portion 76A.

As shown in FIG. 7(A), the guide portion 76A of the terminal 70 has a first recessed curved portion 76A-1 and a first straight portion 76A-2. The first recessed curved portion 76A-1 is positioned in a bottom portion of the guide portion 76A and is adjacent to the supporting portion 76B. The first straight portion 76A-2 extends in a top-to-bottom direction in a top portion of the guide portion 76A. The supporting portion 76B has a second recessed curved portion 76B-1 in a middle portion and second straight portions 76B-2 on the both sides thereof. The first recessed curved portion 76A-1 and the second recessed curved portion 76B-1 have substantially the identical shape.

As shown in FIG. 7(A), a shaft portion 93 of the pressing member 90 has an approximate L-character shape at the open position of the pressing member 90. The guided portion 93A of the shaft portion 93 has a projected curved portion 93A-1 and a contact surface 93A-2. The projected curved portion 93A-1 engages with the first recessed curved portion 76A-1 of the terminal 70 when the pressing member 90 is situated at the open position. The contact surface 93A-2 contacts with the first straight portion 76A-2 that extends in a top-to-bottom direction of the guide portion 76A of the terminal 70.

Further, as shown in FIG. 7(A) that shows a state in which the pressing member 90 is situated at the open position, an edge portion 93A-3 that constitutes a top portion of a guided portion 93A has a shape to conform to the projected curved portion 93A-1. Further, the edge portion 93A-3 has a shape to conform to or accord with the first recessed curved portion 76A when the pressing member 90 is at the closed position.

In the embodiment, when the pressing member 90 moves from the open position to the closed position, the contact surface 93A-2 of the guided portion 93A is guide by the guide portion 76A of the terminal 70 and is then further guided by the supporting portion 76B. At this time, a rotation center 0 of the guided portion 93A linearly moves downward along the guide portion 76A while the guided portion 93A rotates around the rotation center 0 thereof.

As shown in FIG. 7(B), when the pressing member 90 moves to the closed position, the edge portion 93A-3 of the guided portion 93A engages with the first recessed curved portion 76A-1 of the terminal 70 and the projected curved portion 93A-1 of the guided portion 93A engages with the second recessed curved portion 76B-1 of the terminal 70. Accordingly, positions of the shaft portion 93 and consequently the pressing member 90 at the closed position may be stabilized.

Further, a regulated surface 93B-2 of an abutting portion 93B is adjacent to the regulating portion 76C of the terminal 70 at the closed position. Accordingly, a further movement of the pressing member 90 over the closed position is regulated by the regulating portion 76C. That is, even if the pressing member 90 is loaded with an excessive operating force upon closing of the pressing member 90, the pressing member 90 stops at the specific closed position. As a result, the pressing member 90 and consequently the connector 51 are prevented from being damaged due to an excessive movement of the pressing member 90.

In the embodiment, the projected curved portion 93A-1 is provided on a contact surface of the guided portion 93A of the pressing member 90. Further, the first recessed curved portion 76A-1 is provided in the guide portion of the terminal 70. Moreover, the second recessed curved portion 76B-1 is provided in the supporting portion.

As a variation, the contact surface of the guided portion and the supporting portion of the terminal may be formed as flat portions. Further, the first recessed curved portion 76A-1 may be formed in the guide portion of the terminal 70.

According to the variation, the regulated surface of the abutting portion is supported over a large range by the supporting portion that is completely flat at the open position. Accordingly, the pressing member 90 is not displaced for certain even if an excessive load is applied from the suction member upon suction, thereby stabilizing suction. Further, the edge portion engages with the first recessed curved portion at the closed position, which stabilizes a position of the shaft portion 93 or consequently a position of the pressing member 90 at the closed position.

The disclosure of Japanese Patent Application No. 2007-178893, filed on Jul. 6, 2007 is incorporated in the application by reference.

While the invention has been explained with reference to the specific embodiments of the invention, the explanation is illustrative and the invention is limited only by the appended claims.

What is claimed is:

1. An electrical connector, comprising:

a housing to be attached to a circuit board, said housing including an opening portion for receiving a flat conductive member;

a first terminal arranged in the housing along a terminal arrangement direction, said first terminal including a contact portion, a guide portion having a lateral opening, and a supporting portion disposed at a lower side of the lateral opening; and a pressing member attached to the housing to be movable between an open position and a closed position, said pressing member pressing the flat conductive member against the contact portion when the pressing member is situated at the closed position, said pressing member including a sucking surface to be sucked by a suction device, said pressing member further including a shaft portion having a guided portion and an abutting portion with a supported surface formed thereon, said guided portion being arranged in the lateral opening so that the guide portion restricts a movement of the guided portion in a vertical direction, said supported surface being arranged to be supported with the supporting portion and to receive a reaction force in the vertical direction from the first terminal.

2. The electrical connector according to claim 1, wherein said first terminal further includes a regulating portion for regulating a movement of the pressing member, said shaft portion including a regulated surface for abutting against the regulating portion.

3. The electrical connector according to claim 1, wherein said guided portion and said abutting portion have a continuous cross-section taken along a plane perpendicular to the terminal arrangement direction.

4. The electrical connector according to claim 1, further including a second terminal arranged in the housing along the terminal arrangement direction, said second terminal having a shape different from that of the first terminal.

5. The electrical connector according to claim 4, wherein said pressing member further includes a sub shaft portion at a position corresponding to the second terminal along the terminal arrangement direction, said second terminal including two regulating guide portions for regulating the sub shaft portion.

6. The electrical connector according to claim 5, wherein said two regulating guide portions are situated on both sides of the sub shaft portion.

7. The electrical connector according to claim 1, wherein said supporting portion includes a horizontal portion, said guide portion extending from the supporting portion, said guided portion including a contact surface for contacting with the guide portion at the open position and the supporting portion at the closed position.

8. The electrical connector according to claim 1, wherein said guided portion includes a projected curved portion, said guide portion including a first recessed curved portion for engaging with the projected curved portion at the open position and the guided portion at the closed position, said supporting portion including a second recessed curved portion for engaging with the projected curved portion at the closed position.

9. The electrical connector according to claim 1, wherein said guide portion has a size substantially the same as that of the guided portion so that the guided portion is accommodated in the guide portion without a play.

10. The electrical connector according to claim 1, wherein said guided portion has a circular shape substantially the same as a sectional shape of the guided portion so that the guided portion is accommodated in the guide portion without a play.

* * * * *